United States Patent [19]

Dash et al.

[11] Patent Number: 4,719,699

[45] Date of Patent: Jan. 19, 1988

[54] REFERENCE ANTENNAS FOR EMISSION DETECTION

[76] Inventors: Glen Dash, Holden Green 307A, Cambridge, Mass. 02138; Isidor Straus, 8 Longfellow Rd., Wayland, Mass. 01778

[21] Appl. No.: 794,780

[22] Filed: Nov. 4, 1985

[51] Int. Cl.[4] ..... B26F 13/00

[52] U.S. Cl. ..... 30/90.1; 30/279 R; 81/9.4

[58] Field of Search ..... 30/90.1, 92, 182, 279 R; 81/9.4, 9.42; 29/564.4

[56] References Cited

U.S. PATENT DOCUMENTS

Re. 30,342 7/1980 Perrino ..... 81/9.4

*Primary Examiner*—Douglas D. Watts

*Attorney, Agent, or Firm*—Wolf, Greenfield & Sacks

[57] ABSTRACT

A reference antenna construction preferably employing a biconical antenna in combination with a balanced to unbalanced transformer or balun adapted to provide proper matching and operation over a broad frequency range. The reference antenna is used to calibrate other antennas. A ferrite sleeve is preferably used over the balun to reduce unbalanced currents flowing in the shield and to improve performance. A tool is described that allows fast and accurate construction of the balun by providing precise severing of the center conductor.

2 Claims, 11 Drawing Figures

Fig. 5A
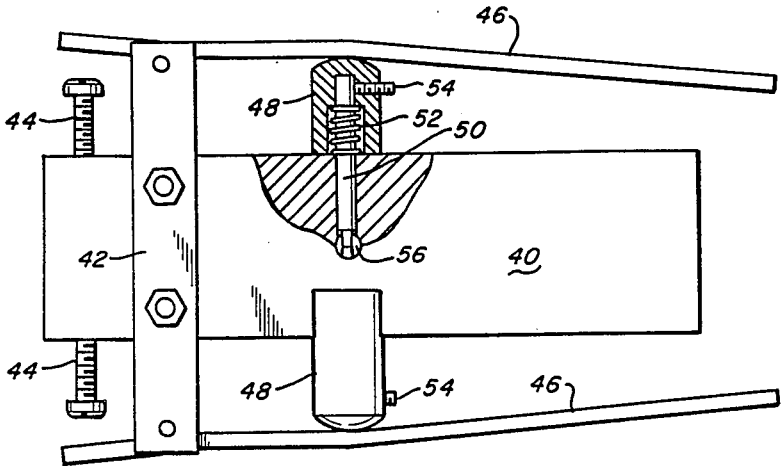
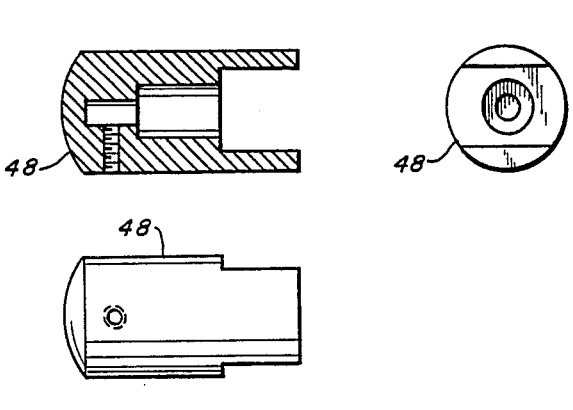
Fig. 5B
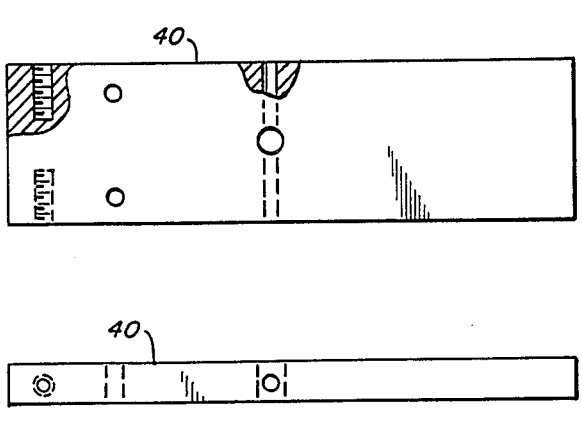
Fig. 5C

REFERENCE ANTENNAS FOR EMISSION DETECTION

BACKGROUND AND SUMMARY OF THE INVENTION

The present invention relates in general to reference antennas for the measurement of emissions from electronic data processing equipment. More particularly, the invention pertains to reference dipole and reference biconical antennas for the measurement of radiated emissions. The invention furthermore relates to a procedure of calibration of other antennas and test sites using the reference antennas. In accordance with the invention the antennas are adapted for the measurement of radiated emissions in the frequency range of 30–1000 MHz.

A reference antenna is one that functions as close to an ideal antenna as possible. An ideal antenna is one whose gain pattern and antenna factor are very close to that predicted in theory. Herein, there are two types of reference antennas that are described, one a dipole antenna and the other a double discone antenna, also known as a biconical antenna.

The traditional biconical antenna covers the frequency range of, say, from 30 to 200 MHz. It is an object of the present invention to provide a new type of biconical antenna which offers broadband, omni directional performance with accurately known VSWR and antenna factors. In accordance with the invention a set of two such biconical antennas may cover a range from 175 to 1000 MHz. They are capable of handling approximately 100 watts for generating strong RF fields for use in susceptibility studies.

It has been found that biconical antennas present a nearly constant impedance at their input terminals between the cones over an extremely wide frequency range. The value of this impedance is determined by the cone angle.

The dipole antenna, at resonance, has a balanced impedance of 73 ohms. To match the 73 ohm impedance to the 50 ohm unbalanced impedance of the coaxial cable, typically found associated with spectrum analyzers and receivers, a balanced to unbalanced transformer, or balun, is used. One of the objects of the present invention is to provide an improved balun that provides for this effective impedance matching with low loss.

In accordance with another feature of the invention there is described herein a technique for the use of the reference antenna to calibrate other antennas. There is also described herein a special tool that is used to allow fast and accurate construction of the antenna and balun. Still in accordance with a further feature of the invention there is described the use of a ferrite sleeve in association with the the balun to reduce unbalanced currents flowing in the shield to thus provide improved performance.

BRIEF DESCRIPTION OF THE DRAWINGS

Numerous other objects features and advantages of the invention should now become apparent upon a reading of the following detailed description taken in conjunction with the accompanying drawings, in which:

FIGS. 5A–5F illustrate the cutter tool of the present invention used in constructing the balun.

DETAILED DESCRIPTION

Figure 3:
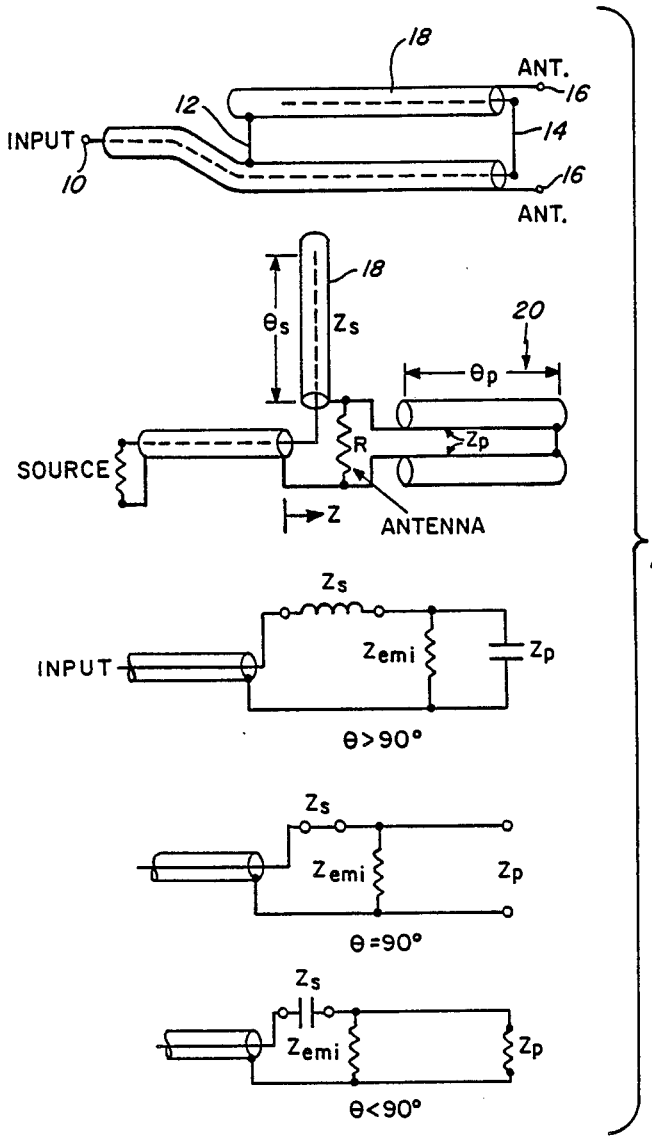
FIG. 3 schematically shows the balun construction along with the equivalent circuits.

Reference is now made to the drawings and in particular to the drawings that illustrate the construction of the baluns for field strength measuring from dipole or biconical antennas. Reference is also made to FIG. 3 which schematically illustrates the balun. The balun is a series/parallel coaxial stub type balun. In FIG. 3 the equivalent circuit shows the impedances as seen from the feed point of the balun. As indicated in FIG. 3 the input is at 10. There is a short circuit line 12 between outer conductors of the coax segments. At the output end of the balun there is also a short circuit line 14 between inner conductors. The schematic diagram of FIG. 3 also illustrates the output connection points 16 to respective antennas.

FIG. 3 also illustrates the antenna in the form of a load represented by the resistor R. With regard to this equivalent circuit it is noted that the short balanced line is in parallel with the load and the open coaxial section 18 is in series with the load. The parallel section 20 forces the load to be fed in a balanced manner. Although the use of a parallel shorted stub alone will effect a balanced/unbalanced transformation, it provides a useful match only over the narrow range where the stub presents a high impedance. The combined action of the series open and parallel shorted stub extends the range of approximate match. The two matching stubs are $\frac{1}{4}$ of an electrical wavelength at the center of the band the balun is to operate in. At the center of this band where both stubs are resonant, the open series coaxial stub looks like a short circuit, while the parallel shorted balun stubs looks like an open circuit. Again, reference is made to the equivalent circuits illustrated in FIG. 3.

Equations for the stub impedances are as follows:

1. Series Stub $Zs = -j\ Zo\ COT\ \theta s$, where $\theta s$ is the electrical length of the series stub and Zo is the characteristic impedance of the coax.
2. Parallel Stub $Zp = j\ Zo\ TAN\ \theta p$, where $\theta p$ is the electrical length of the parallel stub and Zo is the characteristic impedance of the coax.

Compensation occurs as follows: Assume that the electrical angle theta is slightly above 90 degrees, corresponding to a frequency slightly above stub resonance. At that frequency, Zs will be an inductive reactance while Zp will be a capacitive reactance. The lag introduced by Zs is nearly cancelled by the lead produced by Zp. At frequencies below resonance, the role of the stubs is reversed, as shown in FIG. 3. It can be shown that a nearly perfect match exists when:

$$\theta = \text{ARCSIN}\sqrt{(Zo/R\ \text{ANT})}$$

where Zo is the coax chracteristic impedance and the R ANT is the radiation resistance of the antenna.

A voltage standing wave ratio (VSWR) of under 1.5 to 1 can be expected over a frequency range of nearly 3 to 1.

A four antenna set can be used to cover the measurement range of 30–1000 MHz. Detailed physical constructions of the balun and antenna housings are described hereinafter.

For these reference antennas, the antenna factor is equal to:

$$\text{Antenna factor (db)} = 20 \log f - 31.4$$

where f=frequency in MHz

Figure 2:
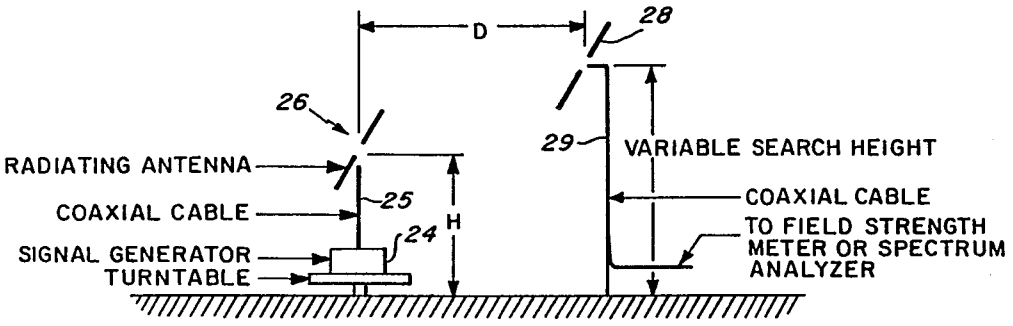
FIG. 2 shows the set-up for performing tests.

In the United States, the standard distance used to measure emissions from data processing equipment over the frequency range of 30–1000 MHz is three meters. In this connection refer to FIG. 2 which illustrates a signal generator 24 coupling by way of coaxial cable 25 to a radiating antenna 26. There is also illustrated the receiving antenna 28 along with coaxial cable 29 that may couple to a field strength meter or spectrum analyzer. To evaluate a test site, the transmitting antenna may be mounted at one end of the site and fixed in height, while a receiving antenna is raised from 1–4 meters at the other end of the site as shown in FIG. 2. The raising and the lowering of the antenna simplifies the mechanical computations, allowing the antenna to pass through a lobe where a a signaled transmitted directly from the transmitting antenna is in phase with the signal reflected off the ground. In order to evaluate a test site, two antennas may be employed and they should match within 2–3 dB of the curves illustrated.

Now, with regard to the calibration of other antennas the antenna of the invention may be used in a conventional site attenuation test. If, at each frequency where the maximum signal is received by the receive antenna, that antenna is removed and a second antenna of any type is substituted, the difference between the receive signal when using the lossless antenna and that received by the substitute antenna can be used to derive the antenna factor for the substitute antenna.

The antenna factor is a mathematical number used to convert field strength received by the antenna specified in microvolts per meter to volts produced at its output. Mathematically the following can be stated:

$$\frac{E}{AF} = Vo$$

where

E=field strength in microvolts/meter

AF=antenna factor

Vo=voltage at the output of the antenna balun, or, in log form $$E(dB) = 20 \log Vo + AF(db)$$

The antenna factors for the antennas of this invention have been described above. By adding the difference between the signal received in decibels to the reference antenna factors, the antenna factor for the new antenna can be derived. For example, if the signal received from the transmitting antenna by the reference antenna at 100 MHz is −12 dBM into 50 ohms, and the signal received by the substitute antenna is −18 dBM, then at 100 MHz, the substitute antenna would have an antenna factor of 6 plus the antenna factor for the reference antenna. Using the same technique, any given antenna can be calibrated over any given range of frequencies.

Figure 4:
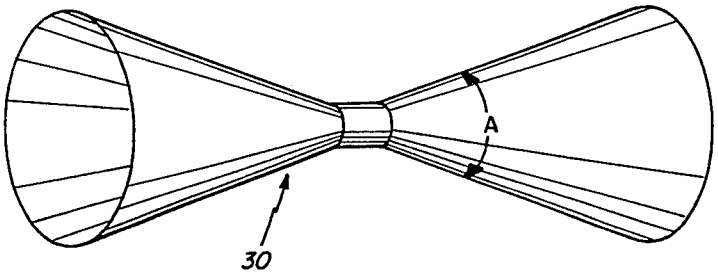
FIG. 4 shows a biconical antenna as in accordance with the present invention.
Figure 4A:
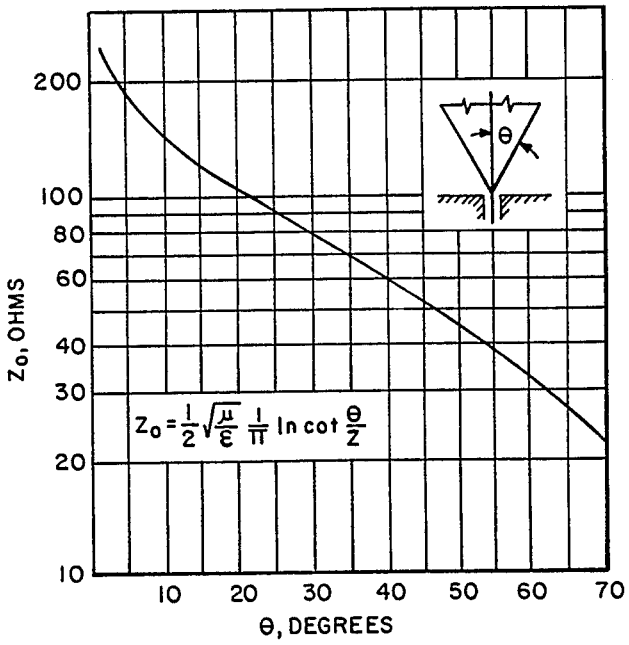
FIG. 4A is a graph of cone angle versus impedance.

Dipole antennas are generally tunable to only one frequency at a time. However, antennas in the shape of a cone as illustrated in FIG. 4 permit resonance over a wide range of frequencies. In this regard, the curve illustrated in FIG. 4A shows how, for different cone angles, the resistance of the antenna dominates over its reactance, and the resistance remains fairly flat with frequency over a wide range, especially at angles between 30 and 35 degrees. This characteristic of cones allows them to be used over a wide range of frequencies without returning. Furthermore, the game pattern for biconical antennas is similar to that of dipoles at resonance over a wide range of frequencies.

Improved reference antenna performance is possible over a wide range of frequencies. In this connection the dimensions that result in this performance are as follows:

$$r = 8'' - 9''$$

$$\theta = 30° - 35°$$

The dimension r above is the maximum radius of the cone and the angle is the cone angle.

Reference is also made to the curves that are shown in the drawings and that demonstrate that the combination of the cones so designed with the balun gives broad band performance with reference antenna characteristics.

Occasionally, due to antenna imperfections, unbalanced currents will flow in the shield of the balun. This has the undesirable characteristic of causing the shield to radiate. This causes a loss of energy which effects the performance of the reference antenna and can cause annoying variation in measurement characteristics as the feed cable is moved. In order to combat this, in accordance with the invention a sleeve of hard ferrite may be placed over the cable, feeding the antenna, at its base. The sleeve should be at least one inch long and have an inside to outside diameter ratio of 2.5 to 1. This allows unbalanced currents in the shield to be removed, restoring the accuracy of the reference antenna whether it be of dipole or biconical type.

Figure 1:
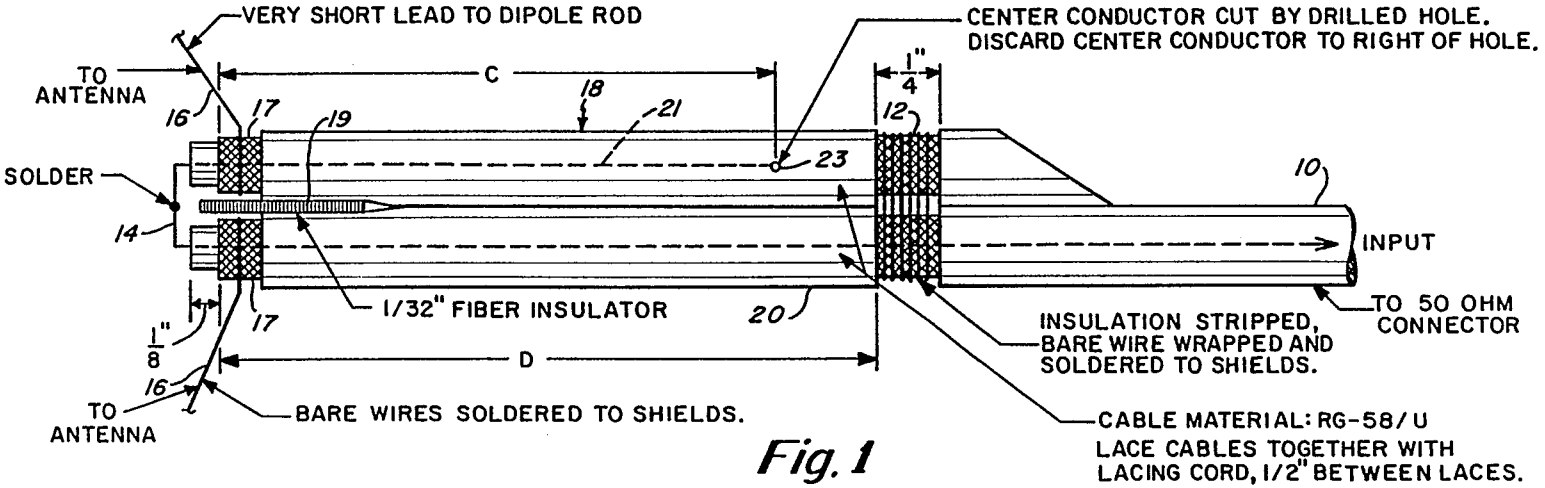
FIG. 1 shows the construction details of the antenna balun.

With regard to FIG. 1 the same reference characters have been applied as discussed previously in connection with FIG. 3. There are thus provided a pair of coaxial segments 18 and 20 in FIG. 1. It is noted that at one position 12 the insulation has been stripped and a bare wire has been wrapped and soldered to the outer conductor or shield of the coaxial conductors. There is also a bare wire 17 that is soldered to the shields at the opposite end. The wires 16 connect therefrom and couple to biconical antennas each such as illustrated in FIG. 4. Also shown in FIG. 1 is a fiber insulator 19 between the coaxial segments. It is noted that with regard to segment 18 that the center conductor at 21 is terminated in an open circuit. Reference is made hereinafter to a tool that is used in severing the center conductor at point 23. The center conductor may be discarded to the right thereof as viewed in FIG. 1.

There is also now shown herein in table 1 calculated and measured characteristics for site attenuation performed by the Federal Communications Commission. The readings show excellent correlation between what was predicted in theory and what is actually measured using the antenna of the invention. The set-up used for performing the test which is described in FCC document OST-55, is illustrated in FIG. 2. In general, a three meter spacing is used between the transmit and receive antennas.

In connection with the biconical antenna of FIG. 4, in one embodiment each cone may be approximately 10 inches along the side with a total cone angle of 70°.

Figure 5D:
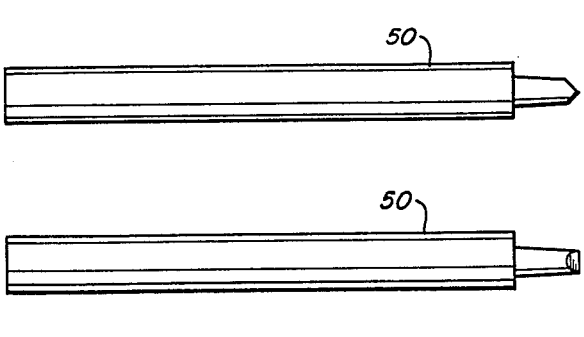
Figure 5E:
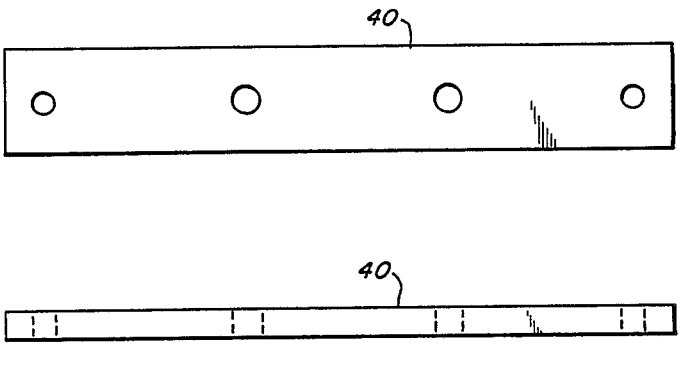
Figure 5F:
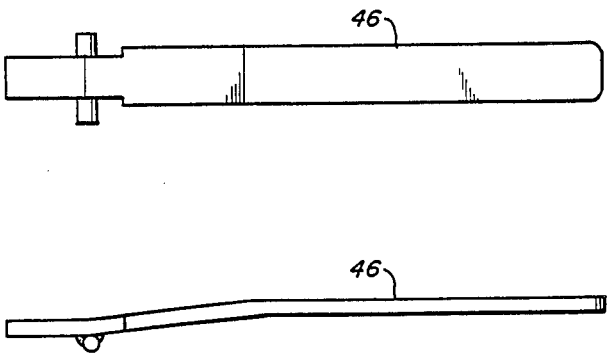

Reference is now made to FIG. 5 which shows a tool used in the construction of the antenna and balun. The construction of the device requires a precise severing of the center conductor of the coax. This precise severing is to be made in such a way as not to disturb the placement of the center conductor. As indicated previously, this severing occurs at point 23 in FIG. 1. In a production environment, drilling out the center conductor is impractical. For example, the action of the drill often disrupts the placement of the center conductor. For this reason a special tool is required for the construction of the product in the production environment.

TABLE 1

CALCULATED AND OBSERVED VALUES OF THE SITE ATTENUATION FOR A 3 METER SITE
POLARIZATION: HORIZONTAL
TRANSMITTING ANTENNA HEIGHT: 2.00 METERS
RECEIVING ANTENNA SCAN: 1 TO 4 METERS
ANTENNA SEPARATION: 3.00 METERS
GROUND REFLECTION COEFFICIENT: −1.00

| FREQUENCY (MHz) | HEIGHT (m) (CALC.) | SITE ATTENUATION (dB) (CALC.) | SITE ATTENUATION (dB) (MEAS.) | DIFFERENCE (dB) |
|---|---|---|---|---|
| 30 | 4.00 | 10.05 | 10.62 | −.57 |
| 35 | 4.00 | 10.64 | 11.48 | −.84 |
| 40 | 4.00 | 10.72 | 12.44 | −1.72 |
| 45 | 4.00 | 10.56 | 12.08 | −1.52 |
| 50 | 3.69 | 10.56 | 11.34 | −.78 |
| 55 | 3.32 | 10.48 | 11.82 | −1.34 |
| 60 | 2.99 | 10.34 | 11.50 | −1.16 |
| 65 | 2.71 | 10.20 | 9.98 | .22 |
| 70 | 2.46 | 10.16 | | |
| 75 | 2.25 | 10.32 | 11.34 | −1.02 |
| 80 | 2.09 | 10.71 | | |
| 85 | 1.97 | 11.26 | | |
| 90 | 1.88 | 11.84 | | |
| 95 | 1.80 | 12.36 | | |
| 100 | 1.72 | 12.82 | 13.24 | −.42 |
| 110 | 1.55 | 13.77 | 15.10 | −1.33 |
| 120 | 1.39 | 14.94 | 15.56 | −.62 |
| 130 | 1.28 | 16.04 | 16.22 | −.18 |
| 140 | 1.19 | 16.59 | 16.08 | .51 |
| 150 | 1.11 | 16.58 | 17.10 | −.52 |
| 175 | 1.00 | 17.73 | | |
| 200 | 2.38 | 20.06 | 21.20 | −1.14 |
| 225 | 2.08 | 20.45 | | |
| 250 | 1.84 | 21.24 | | |
| 275 | 1.65 | 22.56 | | |
| 300 | 1.49 | 23.14 | 22.36 | .78 |
| 350 | 2.21 | 24.68 | 23.60 | 1.08 |
| 400 | 1.88 | 25.45 | 24.72 | .73 |
| 450 | 1.63 | 26.69 | 25.56 | 1.13 |
| 500 | 2.14 | 27.71 | 28.38 | −.67 |
| 550 | 1.28 | 28.25 | 28.80 | −.55 |
| 600 | 1.16 | 29.08 | 29.14 | −.06 |
| 650 | 1.06 | 29.85 | 29.00 | .85 |
| 700 | 1.42 | 30.31 | 28.80 | 1.51 |
| 750 | 1.31 | 30.94 | 28.70 | 2.24 |
| 800 | 1.22 | 31.53 | 30.40 | 1.13 |
| 850 | 1.14 | 31.84 | 30.30 | 1.54 |
| 900 | 1.08 | 32.39 | 29.90 | 2.49 |

In this connection as indicated reference is made to FIG. 5 which shows the cutter which is comprised of a body 40 which supports a side plate 42. The body 40 also supports a pair of stop screws 44 extending in opposite directions as indicated. At the opposite ends of the side plate 42 there are supported a pair of respective handles 46. These handles are pivotally supported from the side plate as indicated and are adapted to bare against the blade holder 48. There are actually a pair of blade holders as indicated in the drawing. In the assembly drawing the blade holders are shown in their compressed position with the associated cutter blades 50 in their contacted or severing position. Within the blade holder 48 there is a compartment that accommodates a return spring 52. There is also provided a set screw 54 for retaining the cutter blade in position in the blade holder.

As indicated, in the assembly drawing the handles have been moved toward each other to force the blade holders toward each other so as to thus cause the cutter blades to move to sever the coaxial cable. The coaxial cable, prior to being severed is inserted into the hole 56 in the body. When the handles 46 are released then the bias of the spring 52 causes the cutter blades to release causing the entire blade holder to move outwardly so that the cutter blade is moved away from the hole 56.

As indicated previously, the tool or FIG. 5 is used to sever the coaxial cable as at 23 in FIG. 1. Once this occurs the center conductor portion to the right of the point 23 in FIG. 1 may be easily removed. This is carried out without any major disruption to the remaining center conductor of the balun.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. In the construction of a balun, a device for severing the center conductor of a coaxial cable without disturbing the center conductor so as to permit removal of a portion of the center conductor, said cutting device comprising a body, said body having means for receiving the coaxial conductor, a pair of cutter blades and means for supporting the cutter blades so that the cutter blades are disposed for operation toward and away from each other and in a direction at right angles to the passage that accommodates the coaxial conductor, and means for mutually operating the cutter blades so as to pierce the coaxial conductor and sever the center conductor thereof, wherein the means for supporting the cutter blades each comprise a blade holder and handle means on opposite sides of the body adapted to be compressed towards each other for operating the blade holders to in turn operate the associtaed cutter blades, wherein each blade holder has a recess for accommodating a biasing spring for normally biasing the blades away from each other.

2. A cutting device as set forth in claim 1 wherein the handles are supported from a sideplate which in turn is supported from the body, said handles being pivotal and extending on one side to operate the blade holder and on the other side against a stop means.

* * * * *